United States Patent [19]

Kosugi

[11] Patent Number: 4,476,451

[45] Date of Patent: Oct. 9, 1984

[54] SOLENOID ACTUATOR

[75] Inventor: Seiji Kosugi, Iwatsuki, Japan

[73] Assignee: Shoketsu Kinzoku Kogyo Kabushiki Kaisha, Tokyo, Japan

[21] Appl. No.: 496,655

[22] Filed: May 20, 1983

Related U.S. Application Data

[63] Continuation-in-part of Ser. No. 336,185, Dec. 31, 1981, abandoned.

[30] Foreign Application Priority Data

Jan. 9, 1981 [JP] Japan ..... 56-2158[U]

[51] Int. Cl.³ ..... H01F 7/08

[52] U.S. Cl. ..... 335/262; 335/281

[58] Field of Search ..... 335/255, 258, 260, 262, 335/281

[56] References Cited

U.S. PATENT DOCUMENTS 4,149,132 4/1979 Richter et al. ..... 335/262

4,233,585 11/1980 Sugimoto et al. ..... 335/262

*Primary Examiner*—George Harris

*Attorney, Agent, or Firm*—Oblon, Fisher, Spivak, McClelland & Maier

[57] ABSTRACT

The solenoid actuator of this invention is provided with a magnetic flanged member for reinforcing the bobbin structure and reducing the magnetic resistance having a flanged portion and a cylindrical portion and inserted said cylindrical portion, whose inner surface is coated with a thin film made of feeble or non-magnetic and wear-resistant material, into the central aperture in a non-magnetic reel-shaped bobbin wound therearound with an energizing coil, and a movable core inserted into the central aperture in the bobbin is guided along the cylindrical portion of the flanged member, whereby the frictional abrasion caused by the sliding movement between the cylindrical portion of the flanged member and the movable core is suppressed and the frictional force caused by the uneven abutment between the outer surface of the movable core and the inner surface of the cylindrical portion of the flanged member is made relatively small to suppress the reduction of the attraction force between the stationary core and the movable core and thereby attaining a smooth operation of the movable core.

8 Claims, 7 Drawing Figures

SOLENOID ACTUATOR

BACKGROUND OF THE INVENTION

This application is continuation-in-part of my copending application Ser. No. 336,185, now abandoned filed on Dec. 31, 1981 for SOLENOID ACTUATOR.

This invention concerns an improvement in solenoid actuator for use with electromagnetic valves and the likes.

A former solenoid actuator has such a structure as shown in FIG. 1, in which a movable core 12 is attracted to a stationary core 13 upon supply of energizing current to an energizing coil 11 and the movable core 12 is returned to its home position by the resiliency of a return spring (not shown) upon interruption of the energizing current. However, since a non-magnetic guide pipe 15 (more than 0.3 mm of thickness) and a slight gap 16 (0.1–0.2 mm) are present between the movable core 12 and a magnetic frame 14 made of ferromagnetic material surrounding the energizing coil 11, the magnetic resistance in the magnetic flux paths is increased, whereby the magnetic flux density is decreased to weaken the electromagnetic force between the stationary core 13 and the movable core 12. This defect can not be overcome satisfactorily if an auxiliary flanged magnetic frame 17 made of ferromagnetic material is provided between the magnetic frame 14 and the guide pipe 15 for increasing the cross sectional area of the magnetic flux paths because of a large gap present in the paths. In addition, the presence of the guide pipe 15 complicates the manufacture of the solenoid assembly.

On the other hand, it is known, for instance, by U.S. Pat. No. 4,236,131 that a solenoid actuator in which a movable core is directly inserted into a flanged member made of ferromagnetic material, by removing a guide pipe in a former solenoid structure as shown in FIG. 1, in order to reduce the magnetic resistance therebetween.

However, in such a solenoid it is problem that an attraction force between the movable core and the stationary core is partially reduced by the frictional force which is caused by the frictionally sliding of the movable core when the movable core is magnetically attracted at a certain position on the inner surface of the cylindrical portion of the flanged member. Specifically, when the guide pipe is removed from the solenoid structure in FIG. 1, the inner surface of the cylindrical portion of the flanged member can be brought to face with the outer circumferential surface of the movable core with a slight gap required for fitting them and therefore to reduce the magnetic resistance between the flanged member and the movable core. However in this case, when the movable core is intensely attracted to a certain position at the inner surface of the cylindrical portion of the flanged member, the frictional force at the contact portion is significantly increased. Since an electromagnetic attraction force between two ferromagnetic materials is in an inverse proportion to the square of the distance between them, if the movable core loosely inserted into the flanged member with a slight gap to the inner surface thereof has once been attracted to a certain position on the inner surface of the flanged member, the attraction force at the contact portion is increased significantly and, while on the other hand, the attraction force exerted between the other portions of the movable core and the inner surface of the flanged member is made relatively smaller, whereby the movable core is abutted against the cylindrical portion of the flanged member in an extremely uneven state.

SUMMARY OF THE INVENTION

This invention has been made in vew of the foregoing problems in the prior solenoid actuators referred to above and a principal object of this invention is to provide a solenoid actuator capable of suppressing a frictional abrasion which caused by the sliding movement between the cylindrical portion of the flanged member and the movable core by means of a feeble or non-magnetic and wear-resistant thin film layer coated on the inner surface of the cylindrical portion of the flanged member.

Another object of this invention is to provide a solenoid actuator capable of suppressing such uneven abutment between the inner surface of the cylindrical portion and the movable core by means of said thin film layer.

A further object of this invention to provide a solenoid actuator wherein the positioning of the bobbin that guides the axial sliding of the movable core is made more easily and reliably by using a magnetic flanged member and the stationary core fixed to the magnetic frame to render the axial reciprocation of the movable core more smooth and stable, whereby the uneven abutment between both of the cores can be reduced upon attracting operation to enable the abrasion in the magnetic pole surfaces and the sliding surfaces of the movable core to be decreased as much as possible.

A still further object of this invention is to provide a solenoid actuator wherein a step is formed to the movable core for engagment against the end of the cylindrical portion of the flanged member thereby enabling to prevent the movable core from excessively projecting out of the bobbin or control the projecting extent thereof.

In order to attain the above purpose, the solenoid actuator according to this invention comprises a non-magnetic reel-shaped bobbin wound therearound with an energizing coil, a magnetic frame disposed to the outside of the said bobbin for forming magnetic flux paths, a magnetic flanged mamber having a cylidrical portion and flanged portion and inserted said cylindrical portion into the central aperture in said bobbin for reinforcing the bobbin and reducing the magnetic resistant and a pair of cores inserted directly into the central aperture in the bobbin that exert electromagnetic force to each other upon supply of energizing current to the coil, with the outer circumferential surface of one of the cores which is made movable being opposed directly with a slight gap to the inner surface of the cylindrical portion of the flanged member and the flanged portion of the flanged member being in contact with the magnetic frame, so as to attract the movable core to the other of the cores by the electromagnetic force, wherein inner surface of the cylindrical portion of the flanged member is coated with a thin film made of feeble or non-magnetic and wear-resistant material.

The disposition of the such a thin film on the inner surface of the cylindrical portion of the flanged member can suppress the frictional abrasion caused by the sliding movement between the cylindrical portion of the flanged member and the movable core due to the wear-resistant property of the thin film. Further, the thin film forms a feeble or non-magnetic thin film layer between the inner surface of the cylindrical portion of the flanged member and the movable core. Accordingly, if the movable core is attracted at a certain position on the inner surface of the cylindrical portion of the flanged member, since the electromagnetic attraction force is in an inverse proportion to the square of the distance between the two members, the attraction force is not increased significantly by said thin film layer, whereby the frictional force between the flanged member and the movable core is made relatively small to suppress the reduction of the attraction force between the stationary core and the movable core and thereby attaining a smooth operation of the movable core. In this case, although said thin film layer and a gap required for the sliding movement of the movable core are formed between the inner surface of the cylindrical portion of the flanged member and the outer circumferential surface of the movable core, it will be apparent that the magnetic resistance can be reduced remarkably as compared with the case where the guide pipe 15 is provided as shown in FIG. 1.

Furthermore, in a modified embodiment, a slit for eddy current elimination may be provided to the flanged member. In a further embodiment, the flanged portion of the flanged member is contacted closely to the magnetic frame so as to put the magnetic frame between the flanged portion of the flanged member and the end face of the bobbin, whereby the bobbin is positioned at its one end and the stationary core or another flanged member is fitted to the opening at the other end of the magnetic frame and inserted into the central aperture in the bobbin whereby the bobbin is positioned at its other end.

In a further embodiment, a step is formed to the movable core for abutting to engage against the end face of the cylindrical portion of the flanged member in order to prevent the movable core from excessively projecting out of the bobbin or control the projecting extent.

The above and other objects and features of this invention will appear more fully hereinafter from a consideration of the following description taken in connection with the accompanying drawings wherein one example is illustrated by way of example.

BRIEF DESCRIPTION OF THE ACCOMPANYING DRAWINGS

FIG. 1 is a cross sectional view of a conventional solenoid actuator,

FIG. 2 is a cross sectional view of the first embodiment according to this invention, FIG. 3 is a cross sectional view of the bobbin thereof in a disassembled state, FIG. 4 is a perspective view of the flanged member thereof, FIG. 5 is a cross sectional view of the second embodiment according to this invention, FIG. 6 is a cross sectional view of the third embodiment according to this invention, and FIG. 7 is a cross sectional view of the fourth embodiment according to this invention.

DESCRIPTION OF THE EMBODIMENT

Figure 2:
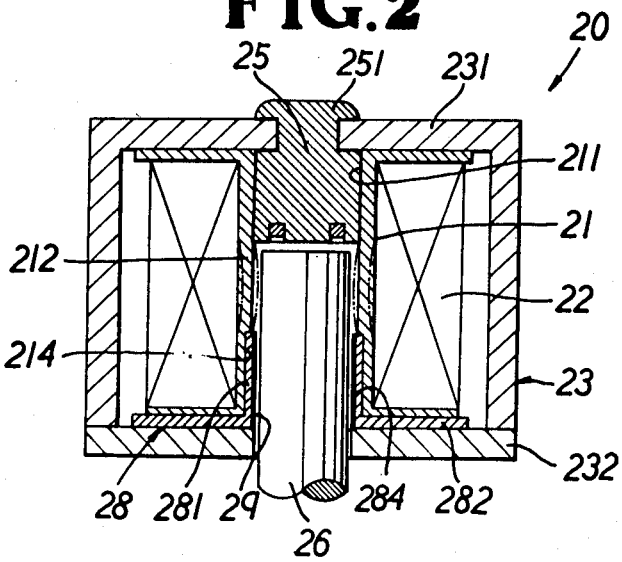

As shown in FIG. 2, a solenoid actuator 20 comprise a bobbin 21, an energizing coil 22 wound therearound and a magnetic frame 23 made of ferromagnetic material disposed to its outside for forming magnetic flux paths and a pair of stationary core 25 and a movable core 26 inserted into the central aperture 211 of the bobbin 21 that exert electromagnetic force to each other upon supply of energizing current to the coil. The stationary core 26 is directly fitted to one end of the central aperture 211 in the bobbin 21 and the movable core 26 which is to be attracted to the stationary core 25 is inserted in the central aperture 211 from the other end axially slidably. The upper exposed end 251 of the stationary core 25 is fitted to the top plate 231 of the magnetic frame 23.

Figure 3:
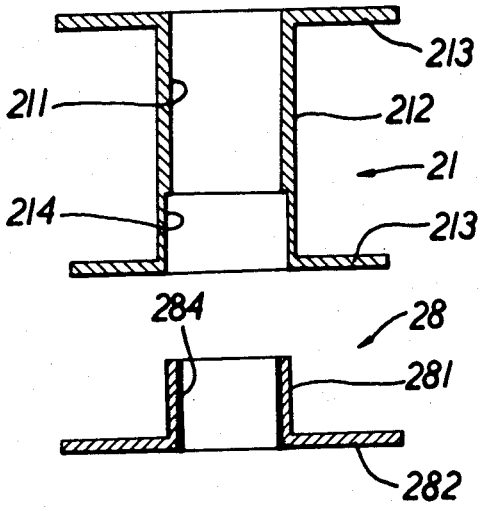
Figure 4:
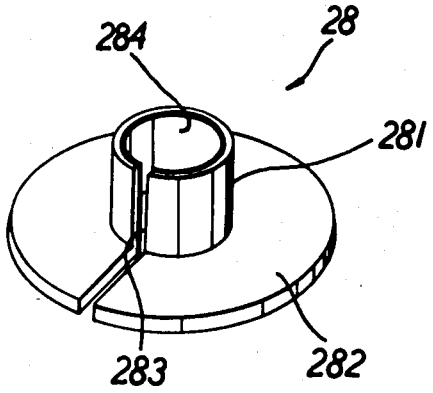

As shown in FIG. 3, the bobbin 21 comprises a non-magnetic reel-shaped member around which the coil 22 is wound, and a magnetic flanged member 28 as shown in FIG. 4 is mounted at least one end thereof for reinforcing the bobbin structure and for reducing the magnetic resistance. Specifically, the bobbin 21 comprises an axial pipe 212 and flanges 213, 213 integrally formed at both ends of the pipe with an enlarged diameter bore 214 being formed on one end of the central aperture 211 for inserting the cylindrical portion 281 of the flanged member 28. The enlarged diameter bore 214 is fitted with the cylindrical portion 281 of the flanged member 28 having an inner diameter slightly smaller than the inner diameter of the central aperture 211 in the bobbin 21. The flanged member 28 comprises the cylindrical portion 281 and a flanged portion 282 for abutment against the flange 213 of the bobbin 21 and has a slit 283 recessed therein for eddy current elimination.

The inner surface of the cylindrical portion 281 of the flanged member 28 is coated with a thin film 284 made of feeble or non-magnetic and wear-resistant material. For the feeble magnetic and wear-resistant thin film 284, though various plating layers can be employed, for example, the plating layer formed through hard chromium plating and those referred to as KANIZEN plating layers (trade name of General American Transportion Corp. exhibiting feeble magnetic property) which is a kind of nickle plating and formed through chemical catalytic reaction (KANIZEN process) are suitable. For the non-magnetic and wear-resistant thin film 284, for example, the coating of thin film made of fluorine-contained polymers or like other wear-resistant synthetic resins are suitable. These thin films 284 are formed within a thickness generally about 5–50 μm and, preferably, of about 10–30 μm. Further, the feeble magnetic or non-magnetic and wear-resistant thin films 284 can be coated, as required, also on the outer circumferential surface of the movable core and it is advantageous in this case to define the total thickness of both of the thin films to less than 70 μm in order to attain a great attraction force between both of the cores.

In the case of disposing such a thin film 284, the diametrical air gap between the flanged mamber 28 and the movable core 26 is formed within a range of about 0.1–0.3 mm in order to enable the sliding movement of the movable core 26.

Consequently, the solenoid actuator 20 is assembled by inserting the cylindrical portion 281 of the flanged member 28 into the central aperture 211 in the bobbin 21, incorporating them into the magnetic frame 23, inserting the movable core 26 into the cylindrical portion 281 of the flanged member 28 which is used as the guiding face for the axial sliding of the movable core 26 and contacting the flanged portion 282 of the flanged member 28 to the bottom plate 232 of the magnetic frame 23.

In the solenoid actuator 20 having the costitution referred to above shown in FIG. 2, the movable core 26 is normally biased by a spring (not shown) or the like in the direction aparting from the stationary core 25 when no energizing current is supplied to the coil 22, but the movable core 26 is magnitically attracted to the stationary core 25 against the resiliency of the spring or the like when the energizing current is supplied to the coil 22.

In the solenoid actuator of this embodiment, since the flanged member 28 having the flanged portion 282 contacted to the inner surface of the bottom plate 232 of the magnetic frame 23 is opposed at its cylindrical portion 281 to the movable core 26 with a slight gap and over a wide area, the magnetic resistance in the magnetic flux paths is reduced to increase the magnetic flux density and, since the flanged member 28 is formed with the slit 283 for eddy current elimination, electrical power supplied can be used effectively, whereby a large attraction force can be obtained between the movable core 26 and the stationary core 25 with less electrical power consumption.

Figure 1:
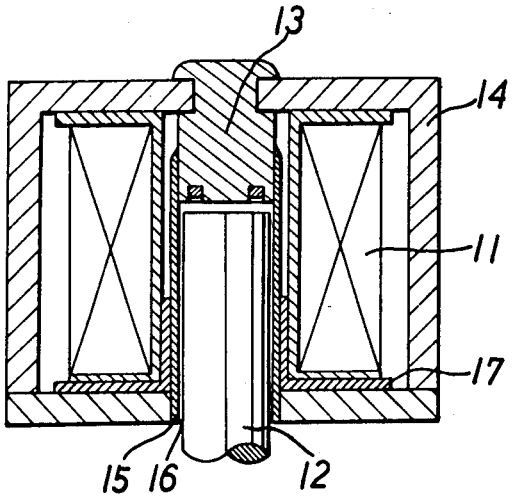
FIG.1 PRIOR ART

Specifically, the disposition of the thin film 284 on the inner surface of the cylindrical portion 281 of the flanged member 28 can suppress the frictional abrasion caused by the sliding movement between the cylindrical portion 281 of the flanged member 28 and the movable core 26 because of the wear-resistant property of the thin film 284. Further, the thin film 284 forms a feeble or non-magnetic thin film layer between the inner surface of the cylindrical portion 281 of the flanged member 28 and the movable core 26. Accordingly, if the movable core 26 is attracted at a certain position on the inner surface of the cylindrical portion 281 of the flanged member 28, since the electromagnetic attraction force is in an inverse proportion to the square of the distance between the two members, the attraction force is not increased significantly by said thin film layer, whereby the frictional force between the cylindrical portion 281 of the flanged member 28 and the movable core 26 is made relatively small to suppress the reduction of the attraction force between the stationary core 25 and the movable core 26 and thereby attaining a smooth operation of the movable core 26. In this case, although said thin film layer and a gap 29 required for the sliding movement of the movable core 26 are formed between the inner surface of the cylindrical portion 281 of the flanged member 28 and the outer circumferential surface of the movable core 26, it will be apparent that the magnetic resistance can be reduced as compared with the case where the guide a pipe 15 is provided as shown in FIG. 1.

Further, since the bobbin 21 is reinforced with the flanged member 28, it is no more necessary to insert an additional guide pipe to the central aperture 211 in the bobbin 21, which enable to reduce the overall size, as well as decrease the material and fabrication costs.

Furthermore, since the inner diameter of the central aperture 211 in the bobbin 21 is greatre than the inner diameter of the cylindrical portion 281 of the flanged member 28 where the cylindrical portion 281 of the flanged member 28 is fitted into the bobbin 21 as shown in FIG. 2, if the axial pipe 212 is forced inwardly as shown by the chained line by the winding of the coil 22 around the bobbin 21, the sliding movement of the movable core 26 is not affected by frictional contact for the inner surface of the central aperture 211.

Figure 5:
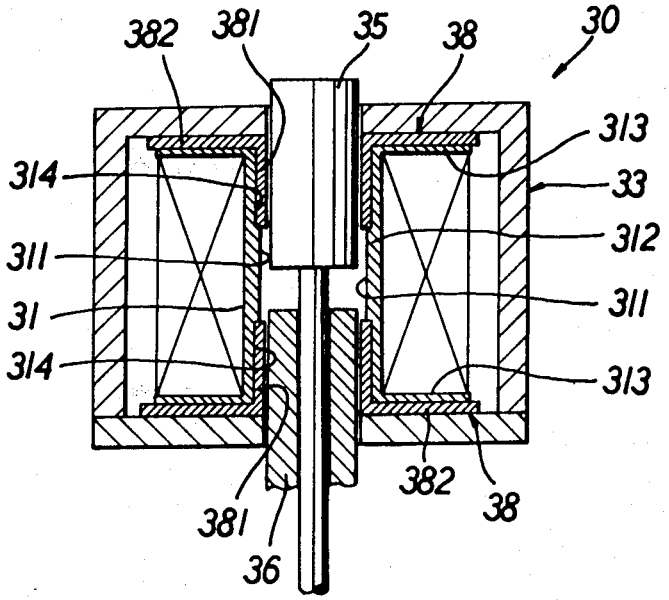

FIG. 5 shows a solenoid actuator 30 as the second embodiment according to this invention, wherein a pair of cores 35, 36 are made movable respectively and attracted to each other. A bobbin 31 incorporated in the solenoid comprises an axial pipe 312 and flanges, 313 provided on both ends. Enlarged diameter bores 314, 314 are formed on both ends of a central aperture 311 and the cylindrical portion 381, 381 of the flanged member 38, 38 is inserted into the enlarged diameter bores 314, 314 respectively. The inner surface of the cylindrical portion 381, 381 of the flanged member 38, 38 are coated with a thin film which is made of feeble magnetic or non-magnetic and wear-resistant material in the same manner as the first embodiment.

In the solenoid actuator 30 having the foregoing construction, since each of the flanged members 38, 38 is abutted at its flanged portion 382 against the magnetic frame 33 and opposed at its cylindrical portion 381 to each of the cores, the magnetic resistance in the magnetic flux paths can also be reduced to enable effective utilization of the electrical power supplied and obtain great electromagnetic force with less electrical power. In addition, since the bobbin 31 is reinforced at its both ends with the pair of flanged members 38, 38, it can withstand a greater load.

Figure 6:
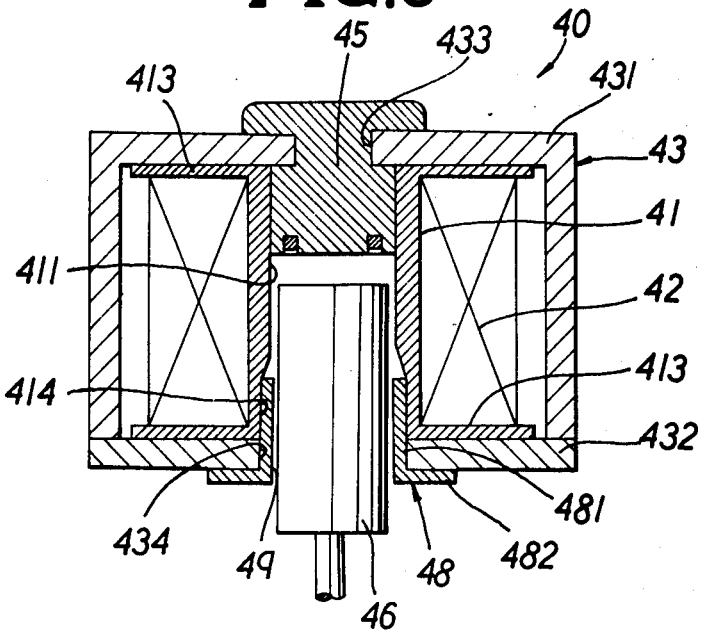

FIG. 6 shows a solenoid actuator 40 as a third embodiment according to this invention, wherein the outside of an energizing coil 42 wound around a bobbin 41 is surrounded with magnetic frame 43 for forming magnetic flux paths, and the bobbin 41 is positioned by a magnetic flanged member 48 and a stationary core 45 fixed to the opposing ends of the magnetic frame 43 respectevely. Specifically, the bobbin 41 is positioned at its one end by fitting the cylindrical portion 481 of the flanged member 48 into an opening 434 at one end of the megnetic frame 43 while contacting the flanged portion 482 of the flanged member 48 to the outer side on the bottom plate 432 of the magnetic frame 43 and inserting the cylindrical portion 481 to the enlarged diameter bore 414 of the central aperture 411 in the bobbin 41. The bobbin is positioned at its other end by fitting a stationary core 45 into the opening 433 in the top plate 431 of the magnetic frame 43 and inserting the core into the central aperture 411 in the bobbin 41.

Further, a movable core 46 which is attracted, when energized, to the stationary core 45 is inserted axially slidably into the cylindrical portion 481 of the flanged member 48 with a slight gap 49, to oppose the cylindrical portion 481 and the movable core 46 directly over a wide area, and the flanged portion 482 of the flanged member 48 is contacted closely to the bottom plate 432 of the magnetic frame 43 in such a way that the bottom plate 432 of the magnetic frame 43 is put betweem the fanged portion 482 of the flanged member 48 and the flange 413 of the bobbin 41.

In the solenoid actuator 40 having the foregoing construction, the flanged member 48 and the stationary core 45 can be positioned by the magnetic frame 43 to which they are fitted and the bobbin 41 can be positioned securely by the flanged member 48 and the stationary core 45. further, since the flanged member 48 employed for the positioning referred to above is opposed at its cylindrical portion 481 directly to the movable core 46 over the wide area and closely contacted at its flanged portion to the magnetic frame 43, the magnetic resistance in the magnetic flux paths can be reduced to obtain great electromagnetic force.

In this case, the inner surface of the cylindrical portion 481 of the flanged member 48 is coated with a thin film which is made of feeble or non-magnetic and wear-resistant material in the same manner as the first embodiment.

Figure 7:
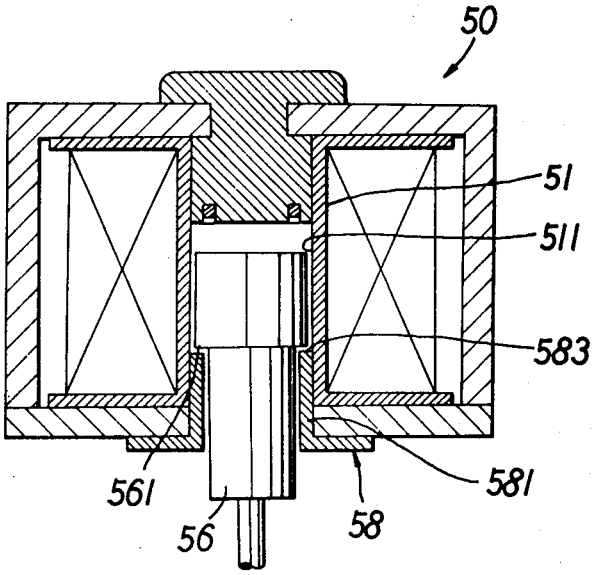

FIG. 7 shows a solenoid actuator 50 as the fourth embodiment according to this invention wherein a step 561 is formed to a movable core 56 for preventing the movable core 56 from excessively projecting out of the bobbin or controlling the projecting extent thereof, and the step 561 abuts to engage against the end face of the cylindrical portion 581 of the magnetic flanged member 58 engaged into the central aperture 511 in the bobbin 51. The central aperture 511 in the bobbin 51 has a uniform inner diameter from one to the other ends thereof In this case, the inner surface of the cylindrical portion 581 of the flanged member 58 is coated with a thin film which is made of feeble or non-magnetic and wear-resistant material in the same manner as the first embodiment.

What is claimed is:

1. A solenoid actuator comprising a non-magnetic reel-shaped bobbin wound therearound with an energizing coil, a magnetic frame disposed to the outside of said bobbin for forming magnetic flux paths, a magnetic flanged member having a cylindrical portion and a flanged portion with the cylindrical portion inserted into the central aperture in said bobbin for reinforcing the bobbin structure and reducing the magnetic resistance and a pair of cores inserted directly into the central aperture in said bobbin that exert electromagnetic force toward each other upon supply of energizing current to said coil, the outer circumferential surface of one of the cores which is made movable being opposed directly with a slight gap to the inner surface of the cylindrical portion of said flanged member and the flanged portion of said flanged member being in contact with said magnetic frame, so as to attract said movable core to the other of the cores by said electromagnetic force, wherein the inner surface of the cylindrical portion of said flanged member is coated with a thin film made of feeble or non-magnetic and wear-resistant material.

2. The solenoid actuator as defined in claim 1, wherein the slightly gap between the outer circumferential surface of the movable core and the inner surface of the cylindrical portion of the flanged member is set between 0.1–0.3 mm in diameter, and the thickness of the thin film coated on the inner surface of the cylindrical portion is set between 5–50 $\mu$m.

3. The solenoid actuator as defined in claim 1, wherein the thin film coated on the inner surface of the cylindrical portion of the flanged member is formed with a hard chromium plating layer.

4. The solenoid actuator as defined in claim 1, wherein the thin film coated on the inner surface of the cylindrical portion of the flanged member is formed with a KANIZEN plating layer

5. The solenoid actuator as defined in claim 1, wherein the thin film coated on the inner surface of the cylindrical portion of the flanged member is formed with a coating made of fluorine-contained polymers resin.

6. The solenoid actuator as defined in claim 1, wherein the flanged member is provided with a slit for eddy current elimination therein.

7. The solenoid actuator as defined in claim 1, wherein the bobbin is positioned at its one end by closely contacting the flanged portion of said flanged member so as to put one end of the magnetic frame between said flanged portion and the end face of the bobbin, and positioned at its the other end by fitting the stationary core or another flanged member into the opening at the other end of the magnetic frame and inserting it into the central aperture in the bobbin.

8. The solenoid actuator as defined in claim 1, wherein a step is formed to the movable core for engagement against the end face of the cylindrical portion of said flanged member.

* * * * *